US012790757B2

(12) United States Patent
Giesel et al.

(10) Patent No.: US 12,790,757 B2
(45) Date of Patent: Nov. 10, 2026

(54) DISPERSIBLE PAPER, METHOD FOR PRODUCING SAME, PACKAGING AND USE OF SAID PAPER

(71) Applicant: Klabin S.A., São Paulo (BF)

(72) Inventors: Guilherme Giesel, Lages (BR); Gustavo Esmério Da Silva, Lages (BR)

(73) Assignee: Klabin S.A., São Paulo (BR)

( * ) Notice: Subject to any disclaimer, the term of this patent is extended or adjusted under 35 U.S.C. 154(b) by 187 days.

(21) Appl. No.: 18/579,219

(22) PCT Filed: Jun. 30, 2022

(86) PCT No.: PCT/BR2022/050246

§ 371 (c)(1),
(2) Date: Jan. 12, 2024

(87) PCT Pub. No.: WO2023/283710

PCT Pub. Date: Jan. 19, 2023

(65) Prior Publication Data

US 2024/0344274 A1 Oct. 17, 2024

(30) Foreign Application Priority Data

Jul. 15, 2021 (BR) ..... 1020210139358

(51) Int. Cl.

| | |
|---|---|
| ***D21H 21/24*** | (2006.01) |
| ***B65D 65/46*** | (2006.01) |
| ***D21D 1/20*** | (2006.01) |
| ***D21F 11/02*** | (2006.01) |
| ***D21H 11/04*** | (2006.01) |
| ***D21H 17/34*** | (2006.01) |
| ***D21H 19/38*** | (2006.01) |
| ***D21H 19/54*** | (2006.01) |
| ***D21H 21/10*** | (2006.01) |
| ***D21H 21/12*** | (2006.01) |
| ***D21H 23/04*** | (2006.01) |
| ***D21H 27/10*** | (2006.01) |

(52) U.S. Cl.

CPC ..... *D21H 21/10* (2013.01); *B65D 65/46* (2013.01); *D21D 1/20* (2013.01); *D21F 11/02* (2013.01); *D21H 11/04* (2013.01); *D21H 17/34* (2013.01); *D21H 19/385* (2013.01); *D21H 19/54* (2013.01); *D21H 21/12* (2013.01); *D21H 23/04* (2013.01); *D21H 27/10* (2013.01); *B65D 2565/382* (2013.01)

(58) Field of Classification Search

CPC ..... D21H 21/24

USPC ..... 162/11, 164.6

See application file for complete search history.

(56) References Cited

U.S. PATENT DOCUMENTS

| | | | |
|---|---|---|---|
| 2003/0019594 A1 | 1/2003 | Altheimer et al. | |
| 2009/0065164 A1 | 3/2009 | Goto et al. | |
| 2011/0061825 A1 | 3/2011 | Li et al. | |
| 2012/0055643 A1* | 3/2012 | Neal | C11D 17/041 162/158 |
| 2013/0133848 A1 | 5/2013 | Heijnesson-Hultén et al. | |
| 2013/0192783 A1 | 8/2013 | Devenney et al. | |
| 2016/0348319 A1 | 12/2016 | Ruef et al. | |
| 2020/0063365 A1 | 2/2020 | Parker et al. | |

FOREIGN PATENT DOCUMENTS

| | | |
|---|---|---|
| WO | WO1984002936 A1 | 8/1984 |
| WO | WO2018049522 A1 | 3/2018 |
| WO | WO2020115305 A1 | 6/2020 |

OTHER PUBLICATIONS

International Preliminary Report of Patentability, dated Oct. 6, 2023, regarding International Application No. PCT/BR2022/050246, 33 pages, English translation only.

International Search Report with English translation and Written Opinion, dated Sep. 13, 2022, regarding International Application No. PCT/BR2022/050246, 20 pages.

* cited by examiner

*Primary Examiner* — Jacob T Minskey

(74) *Attorney, Agent, or Firm* — Sheppard Mullin Richter & Hampton LLP

(57) ABSTRACT

The present invention is related to a water dispersible paper, particularly for use in packages in the construction area. The dispersibility of the paper of the present invention is achieved due to the low wet resistance and high capillary absorption and basically consists of an unbleached cellulose-based paper aiming at the reduction of ingredients conventionally used, adding only defoamers and drainage aids in the formulation thereof. The paper of the present invention consists in the elimination of the use of disintegration aids (such as surfactants), gluing agents and dry resistance agents (such as starch). There is further described a manufacturing process for dispersible paper which allows obtaining a paper having low wet tensile strength and high capillary rise without the need for the chemical agents usually known for the manufacture of this type of paper. The present invention further foresees a package containing said paper for use in construction such as in packages for, lime, sand, cellulosic or synthetic fibers or powder pigments, among others.

3 Claims, No Drawings

DISPERSIBLE PAPER, METHOD FOR PRODUCING SAME, PACKAGING AND USE OF SAID PAPER

CROSS-REFERENCE TO RELATED APPLICATIONS

This application is a U.S. National Stage Application under 35 U.S.C. 371 of International Application No. PCT/BR2022/050246, filed Jun. 30, 2022, which claims priority to Brazilian application Ser. No. 102021013935-8, filed Jul. 15, 2021.

FIELD OF THE INVENTION

The present invention is related, in a first aspect, to a water dispersible paper, particularly for use in packages in the construction area. The dispersibility of the paper of the present invention is achieved due to the low moisture resistance and high capillary rise and consists basically in an unbleached cellulose paper without the need of addition of chemical agents usually used in dispersible papers.

Thus, the present invention aims at reducing the ingredients providing a low manufacturing cost, whereby it is only necessary to add defoamer and drainage aids and, consequently, aims at eliminating the use of disintegration aids (such as surfactants), gluing agents and dry resistance agents (such as starch).

There is further described a manufacturing process for dispersible paper which allows obtaining a paper having low wet tensile strength and high capillary rise without the need for the chemical agents usually known for the manufacture of this type of paper.

The present invention further foresees a package containing said paper for use in construction such as in packages for cement, lime, sand, cellulosic or synthetic fibers or powder pigments, among others.

BACKGROUND OF THE INVENTION

The construction area is constantly searching for products which bring safety to the operators, do not harm the environment and are economically viable. Among the several material rejects of the construction area, the paper of the cement packages cannot be reused or recycled, generating considerable impacts to the environment.

It was additionally verified that the handling of cement packages generates the dispersion of fine cement powders which are harmful to the health of the workers in this field.

Considering the above problems, it is sought to develop packages which allow reuse of the package, maintaining the quality of the product and without causing damage to the workers, at a low cost. One solution which is being developed in the state of the art consists in obtaining a paper which disperses in the solution itself wherein the cement is prepared. The package or bag containing the dispersible paper is then inserted "closed" for cement production, whereby the package is disintegrated in a few minutes in the aqueous solution, releasing the product without releasing fine powders and without generating waste in the environment.

Patent document No. 20160348319 is related to a water-soluble unbleached paper bag comprising cellulose fibers containing lignin as main component and one or more additive(s), at least one surfactant is contained as additive, and the bag paper has a relative wet resistance of less than 6% after a 5-minute wetting time. The paper used in this patent presents a starch-based resistance agent, and also admits the use of additives to achieve barrier properties, such as water-soluble polymers, apart from the use of at least one surfactant to reach the desired properties. This document does not refer to the paper of the present invention since it makes no reference to the manufacturing pH of 8.5, cited in this invention and additionally uses additives and surfactants, which ingredients are not used in the present invention, in the same manner, the outer sheet coating with a layer of water-soluble polymers is not applicable to the present invention.

Patent No GB1127177 is related to a paper of improved dry tensile strength and low wet strength, substantially composed of water-laid fibers of unbleached cellulose, bonded together by an ionically adsorbed content of a non-thermosetting cationic polyamine, normally water-soluble, containing at least five amino nitrogen atoms per macromolecule, and having a molecular weight between 1.000 and 10.000.

US2018051417 is related to a paper manufacturing method, which comprises adding to an aqueous suspension of cellulosic pulp paste a polymer in the form of an inverse emulsion comprising a poly N,N-(dialkylaminoalkyl) (met) cationic acrylamide or the quaternates thereof or salts, and dehydrating the cellulose paste to form a paper or cardboard product, wherein the pulp paste contains more than about 75 ppm by weight of water soluble lignin based on the total weight of the pulp paste, and wherein the polymer is added to the pulp paste at a dosage of 0.001 to 1% by weight based on the solids of the cellulose pulp, and wherein the polymer optionally contains a multi-functional monomer. Apart from the mentioned cationic polymer, the paper contains several additives, gluing agents, flocculants, deposit control agents, among others, which are not necessary in the present invention.

Thus, the state of the art provides paper or cardboard products which are dispersible, but they use several additives or polymers in the formulation thereof. The search for alternatives to those usually employed in papers or packages which are dispersible in a solvent is necessary for the development of packages which are safe and effective for the worker and which bring environmental advantages. It is also desirable for the dispersible paper to have a low cost, comprising ingredients which are usually available and easily produced.

SUMMARY OF THE INVENTION

The present invention is related, in a first aspect, to an unbleached paper based on cellulose fibers, containing at least one defoamer and drainage aid.

There is further described a process for preparing dispersible paper and a package or bag based on said dispersible paper and the use thereof.

It was found in the present invention the possibility of obtaining a dispersible paper presenting wet tensile strength (ISO 3781) less than 0.35 KN/m and Kemm capillary rise (ISO 8787) above 18 mm, which allows the paper to be dispersed in an aqueous mixture within up to approximately 5 minutes.

The paper of the present invention is obtained with a smaller number of components relative to the state of the art, whereby it is basically composed by unbleached paper, at least one defoamer and a drainage aid, maintaining the dispersibility efficiency and with lower costs. The paper of the present invention dispenses the use of disintegration aids, such as surfactants and also eliminates the use of dry resistance agents, such as Aluminum Sulfate, rosin-based glues, AKD (Alkyl ketene dimer) or ASA (Alkenyl succinic anhydride).

DETAILED DESCRIPTION OF THE INVENTION

As can be seen from the state of the art, there exist several papers which are soluble, differently from dispersible, in a water-based solvent with application in cement packages. However, the packages of the state of the art which comprise these soluble papers use a high number of additives in the formulation thereof to maintain the suitable wet tensile strength and paper capillarity properties.

Usually, the dispersible papers recommend the use of chemical surfactants in the composition thereof. These surfactants act as essential ingredients in the formulation and have the function of assisting paper disintegration. The known surfactants comprise, for example, non-ionic, anionic, cationic, amphoteric surfactants, fatty alcohols, ethyl ether sulfates, fatty alcohol ethoxylates or phenol ethoxylates, among others.

Still in the usual manner, the dispersible papers require gluing agents in the formulation thereof, such as rosin-based glues, synthetic glues, Aluminum Sulfate, AKD (Alkyl ketene dimer) or ASA (Alkenyl succinic anhydride) and fixative agents such as aluminum sulfate or aluminum polychloride. Another ingredient commonly added to the dispersible paper of the state of the art is a dry resistance agent, among which starch is the better known one.

It was surprisingly discovered that the dispersible paper of the present invention could bring unexpected results relative to low wet resistance and capillary rise with a significant reduction in the ingredients that are usually used in the composition thereof. Thus, a dispersible paper based on unbleached cellulose fiber was developed, containing only the following ingredients: at least one defoamer and at least one drainage aid.

More specifically, the paper of the present invention is free of a disintegration agent, a gluing agent, and a dry resistance agent.

Even more specifically, the paper of the present invention is free of a disintegration aid, such as non-ionic, anionic, cationic, or amphoteric surfactants, free of gluing agents such as aluminum sulfate, rosin-based glues, AKD (Alkyl ketene dimer) or ASA (Alkenyl succinic anhydride) and aluminum polychloride, and free of a dry resistance agent, such as starch.

In a second aspect, for the dispersible paper of the present invention to be capable of being produced solely with these ingredients, it was necessary to develop a process which allowed obtaining the paper with the preserved properties and with a reduction of ingredients. Thus, there was developed a production process in alkaline condition with a pH above 8 only with the addition of defoamers and drainage aids, without the addition of gluing and dry resistance agents.

So that the dispersible paper can be commercially viable, there was also developed a package or bag containing the dispersible paper, said package containing soluble adhesive based on starch white dextrin and calcium carbonate and water-based ink which allows full and effective dispersion of the paper in aqueous medium.

All the percentages, parts or ratios have as a basis the total weight of the paper of the present invention, except where otherwise specified. All the weights referring to the compounds mentioned herein are based on the level of the active, not including solvents or impurities, except where otherwise indicated.

In the present invention the expression "which comprises" means that other ingredients which do not affect the final composition can be added. The paper of the present invention can contain, include, comprise, consist of ingredients, components and essential limitations of the invention herein described.

Thus, the dispersible paper of the present invention consists in an economical, sustainable alternative and with satisfactory properties in terms of dispersion of said paper in aqueous means. Basically, the paper of the invention consists of (i) an unbleached paper composed by 100% cellulose fibers, further containing (ii) at least one defoamer and (iii) at least one drainage aid.

The unbleached paper used in the present invention consists of a kraft sack paper, obtained from long fiber cellulosic pulp, in monolayer, containing grammage which varies between 60 and 110 g/m$^2$. The unbleached paper is comprised of 100% cellulose fibers.

The defoamer described in the present invention has the function of avoiding foam formation in the water circuit of the paper machine.

The defoamers which can be added to the dispersible paper are selected from: alcohol-based defoamers, fatty acids, fatty esters, polymers based on oxyethylene, oxypropylene and oxybutylene units or any other commercial defoamers for use in the cellulose and paper industry or mixtures thereof.

In one aspect of the invention there is used approximately 0.01 to 0.1% defoamer relative to the total weight of the paper. In a preferred embodiment, there is used 0.05% defoamer.

The drainage aid has as an auxiliary function the dewatering of the fibrous suspension in forming the paper.

The drainage aids of the present invention are selected from: polyamines, polyacrylamide copolymers, polyvilamine copolymer, polyethyleneimine and polydiallyldimethylammonium chloride, or any other drainage aids commercially known in the field of cellulose and paper and the mixtures thereof.

In a preferred manner, approximately 0.05 to 0.5% drainage aid is used relative to the total weight of the paper. In a preferred embodiment, there is used 0.1% drainage aid.

In a preferred embodiment, the dispersible paper of the present invention consists of a kraft sack paper, monolayer, containing a grammage between 60 to 110 g/m$^2$, containing 0.045% defoamer and 0.1% drainage agent based on a solution of Polyvilamine Copolymer.

It was verified that the dispersible paper of the present invention, containing only the unbleached paper, a defoamer and a drainage aid, provides satisfactory results in terms of low wet tensile strength (ISO 3781), whereby said property is less than 0.35 kN/m and further provides a high Klemm capillary rise (ISO 8787) above 18 mm, which allows the paper to be dispersed in concrete within approximately 5 minutes agitation.

For the dispersible paper of the present invention to reach the desired low wet tensile strength and capillary rise so that the desired dispersibility of the paper is achieved in the aqueous medium, there was developed a process which allows achieving said properties and with a minimum amount of ingredients.

The process consists of the following steps:

i. Obtaining long fiber unbleached cellulosic pulp by the Kraft process;
ii. Refining the cellulosic pulp in high consistency refining (that is, with a dry pulp content between 28 and 35%) and occasionally in low consistency (that is, with dry pulp content of 3 to 6% in refiner feed.
iii. Purification of the cellulosic pulp;
iv. Adjustment of pH for alkaline condition with addition of an alkalizing agent;
v. Addition of defoamer and drainage aid; and
vi. Formation of paper with grammage between 60 and 110 g/m$^2$ in Fourdrinier type paper machine.

The refining mentioned in step (ii) of the above process consists in an operation which consists of modifying the shape of the cellulosic fibers so that they can be shortened, collapsed, divided lengthwise, or fibrillated. In refining, the fibers pass between the stator blanking bars and the refiner rotor. The consistency is measured by online measurers in the low consistency pulps and by laboratory measurement in the high consistency refining, according to the laboratory methods already known to the art.

The most usual measurement of the refining level is the degree of drainage in terms of CFS (ISO 5267) or SR (ISO 5267). Whereby fiber morphology is also adopted as complementary.

Step (iii) of the purification consists in the removal of solid substances interfering in the suspension which differ from the fibers in size, shape, and deformability. It is a mechanical process which consists basically in passing the cellulosic pulp through pressurized rotating sieves wherein the undesired particles are retained in the sieves and in hydro-cyclones wherein the smaller particles are separated by centrifugal force.

In step (iv) there occurs an important pH adjustment to alkaline condition, wherein it is carried out with the addition of a sodium hydroxide solution at 10% so as to achieve a pH above 8, preferably between 8 and 12.

In step (v) there occurs the addition of defoamers and drainage aids, which are added at separate points before the mixing pump, apart from the dosage monitored by flow measurers, the effects thereof in the process are monitored, such as foam formation and alterations in the vacuum readings and of the water body on flat table.

Finally, in step (vi) there occurs the formation of the paper in Fourdrinier type paper machine. Other technologies are also available such as double-screen and Yankee cylinder.

A third aspect of the invention consists of obtaining a package which can be a paper bag, or a paper-based box comprising the dispersible paper of the present invention and obtained according to the present process. The package comprises the use of dispersible paper for manufacturing all the components thereof and the use of a soluble adhesive, based on cassava starch white dextrin and calcium carbonate, and water-based ink.

Thus, another aspect of the invention consists in the use of dispersible paper in the manufacture of bags or boxes for storing products for concrete mixtures, for use in construction, such as cement, lime, sand and macro and microfibers.

Example 1: Process for Manufacturing Dispersible Paper

This example illustrates the results obtained in the first dispersible paper industrial production test with grammage of 83 g/m$^2$ for the manufacture of packages with capacity for 50 kg.

The dispersible paper with grammage of 83 g/m$^2$ was produced in paper machine 23 (MP 23) at the Correia Pinto, SC unit of Klabin SA. Cellulosic pulp was used at a cooking degree measured by the Kappa number 58.8 and obtained as from *Pinus* ssp. wood chips prepared in Batch type digester by the kraft pulping process using the liquid wood ratio of 4:1; Applied Active Alkali of 18.0%, Sulfidity of White Liquor of 29.1%, Maximum cooking temperature of 170° C., and H factor 1073.

After purification and washing the cellulosic pulp presented a pH of 9.4, Conductivity of 1091 μS and refining degree of 726° CSF.

It was refined in a high consistency refining system (32%) up to the refining charge of 603° CFS wherein there was applied a refining charge of 210 Kwh/t and up to the refining degree of 580° CFS in low consistency refining system (4.0%) wherein there was applied a refining charge of 14 Kwh/t.

The dosage of rosin-based glue, starch and aluminum sulfate was reduced to zero and the dosage of the commercial defoamer AFRANIL MTC—Basfem 0.045% was maintained. There was added 0.05% of drainage aid Hercobond 2000—Solenis Added 0.25% of Sodium Hydroxide solution 10% before the mixing pump to elevate the pH in the inlet box to 8.5. In these conditions there was produced a batch of 3 rolls with a total of 3.2 tons.

In this batch there was found a wet tensile strength in the MD direction of 0.35 kN/m and a Klemm capillary rise of 25 mm. The results obtained for the remaining physical tests are presented in table 1 below and complied with the specification limits practiced for the conventional paper produced at the unit for use in the segment of packages for cements.

TABLE 1

Results of Physical Tests of dispersible paper

| Test | Method | Result |
|---|---|---|
| Tensile strength - MD (kN/m) | Tappi T-494 | 4.8 |
| Tensile strength - CD (kN/m) | Tappi T-494 | 4.9 |
| Elongation - MD (%) | Tappi T-494 | 7.9 |
| Elongation - CD (%) | Tappi T-494 | 6.5 |
| TEA - MD (J/m$^2$) | Tappi T-494 | 224 |
| TEA - CD (J/m$^2$) | Tappi T-494 | 208 |
| Tear Strength - MD (mN) | Tappi T-414 | 1111 |
| Tear Resistance - CD (mN) | Tappi T-494 | 1215 |
| Air Resistance (s/dL) | Tappi T-460 | 12 |

From the paper produced, there were converted bags with capacity for 50 kg, comprised of two sheets of dispersible paper with 83 g/m$^2$, with open shape of 1090×780 mm and closed with 645×535×110 mm, with 20 mm overlaying in longitudinal gluing and transversely cut with 20 mm difference between one sheet and another to ensure resistance at the anchor points of the adhesive at the bottom closure. The bag presents a valve reinforcement, for product bagging (cement) comprised of dispersible paper of 83 g/m$^2$, with a 200×160 mm dimension. Further, said package is printed by the flexographic process using water based ink and glued with starch based adhesive, comprised of cassava starch white dextrin—(C6H10O5)n—CAS nr 9004-53-9—40%; Calcium Carbonate ($CaCO_3$)—CAS nr 471-34-1—10% and Water ($H_2O$)—50%.

The CAS number or CAS registry number of a chemical compound, polymer, biological sequence and alloy is a unique numeric identifier in the databank of the Chemical Abstracts Service, a division of the Chemical American Society. The Chemical Abstracts Service attributes these numbers to each chemical product which is described in literature. Additionally, CAS maintains and commercializes a databank of these substances: the CAS Registry.

The dispersion test was conducted using a concrete mixer with a capacity for 140 liters. There were used the components and proportions described in table 2 below.

TABLE 2

Components and their proportions in concrete

| Raw material | Amount (kg) |
|---|---|
| Cement CP II F 40 | 25.0 |
| Sand | 72.0 |
| Stones and pebbles | 145.2 |
| Water | 19.0 |

The dispersible bag was fractioned and added ½ the package together with the cement in the mixer.

A mixture of concrete with the addition of water was initiated, followed by the stone and pebbles and subsequently the package fraction and the cement.

Next, agitation was started for 2 minutes with the axis adjusted at 45°.

Sand was added and agitated for 3 more minutes.

Two samples of approximately 5 kg were removed and washed over a sieve with an opening of 4.5 mm wherein there was not observed retention of undispersed paper particles. The concrete was poured in molds for manufacturing concrete parts and there was not observed the presence of paper particles on the surface of the parts or in the walls and paddles of the cement mixer.

Example 2: Production Test in Industrial Scale of Manufacturing of the Dispersible Paper The example described below shows the production test in industrial scale of manufacturing of the dispersible paper with a grammage of 75 g/m$^2$ to meet the manufacturing of packages with 25 kg capacity.

The dispersible paper with a grammage of 75 g/m$^2$ was produced in paper machine 23 (MP 23) at the Correia Pinto, SC unit of Klabin SA from cellulosic pulp with cooking degree in terms of Kappa number 47.0. The pulp was obtained from cooking *Pinus* ssp wood chips in Batch type digester by the kraft pulping process with the liquid wood ratio of 4:1; Applied Alkali Active of 18.7%, White Liquor Sulfidity of 29.8%, Maximum cooking temperature 170° C., and pH factor 1080.

After purification and washing the cellulosic pulp presented a pH of 8.3, Conductivity of 1881 μSS and refining degree of 738° CSF.

It was refined in high consistency refining system (28%) up to the refining degree of 605° CFS wherein there was applied a refining charge of 330 Kwh/t and up to the refining degree of 498° CFS in low consistency refining system (4.0%) wherein there was applied a refining charge of 26 Kwh/t.

In the paper machine the rosin-based glue dosage, starch and aluminum sulfate were reduced to zero, maintained the dosage and commercial defoamer Afranil MTC—Basf in 0.045%. The pH in the inlet box was elevated to 9.5 with the addition of 0.35% of a Sodium Hydroxide solution at 10% before the mixing pump. As drainage agent there was also added before the mixing pump, 0.05% of a solution of the drainage agent Polyvilamine Copolymer. In these conditions there was produced a batch of 3 rolls of 3.8 tons, wherein there was reported a wet tensile strength in the MD direction of 0.10 KN/m and a Klemm capillary absorption of 31 mm.

The results obtained for the remaining physical tests were carried out, according to the following table and meet the specification limits practiced for the conventional paper produced at the unit for use in the segment of packages for cements.

TABLE 3

Results of Physical Tests for Dispersible Paper obtained in industrial scale

| Test | Method | Result |
|---|---|---|
| Tensile strength - MD (kN/m) | Tappi T-494 | 4.4 |
| Tensile strength - CD (kN/m) | Tappi T-494 | 3.7 |
| Elongation - MD (%) | Tappi T-494 | 8.1 |
| Elongation - CD (%) | Tappi T-494 | 7.9 |
| TEA - MD (J/m$^2$) | Tappi T-494 | 209 |
| TEA - CD (J/m$^2$) | Tappi T-494 | 201 |
| Tear Strength - MD (mN) | Tappi T-414 | 1274 |
| Tear Resistance - CD (mN) | Tappi T-494 | 1244 |
| Air Resistance (s/dL) | Tappi T-460 | 10 |

From the paper produced, there were converted bags with capacity for 25 kg, comprised of two sheets of dispersible paper with 75 g/m$^2$, with open shape of 840×590 mm and closed with 445×410×115 mm, with 20 mm overlaying in longitudinal gluing and transversely cut with 20 mm difference between one sheet and another to ensure resistance at the anchor points of the adhesive at the bottom closure. The bag presents a valve reinforcement, for product bagging (cement) comprised of dispersible paper of 75 g/m$^2$, with a 210×160 mm dimension. Further, said package is printed by the flexographic process using water based ink and glued with starch based adhesive, comprised of cassava starch white dextrin-(C6H10O5)n—CAS nr 9004-53-9—40%; Calcium Carbonate ($CaCO_3$)—CAS nr 471-34-1—10% and Water ($H_2O$)—50%.

The CAS number or CAS registry number of a chemical compound, polymer, biological sequence and alloy is a unique numeric identifier in the databank of the Chemical Abstracts Service, a division of the Chemical American Society. The Chemical Abstracts Service attributes these numbers to each chemical product which is described in literature. Additionally, CAS maintains and commercializes a databank of these substances: the CAS Registry.

The dispersion test was conducted using a concrete mixer with a capacity for 140 liters. There were used the components and proportions described in table 4 below.

TABLE 4

Components and their proportions in concrete

| Raw material | Amount (kg) |
|---|---|
| Cement CP II F 40 | 25.0 |
| Sand | 72.0 |
| Stones and pebbles | 145.2 |
| Water | 19.0 |

A mixture of concrete with the addition of water was initiated, followed by the stone and pebbles and subsequently the package fraction and the cement.

It was placed under agitation for 2 minutes with the axis angle adjusted to 45°.

Sand was added and agitated for 3 more minutes.

Two samples of approximately 5 kg were removed and washed over a sieve with an opening of 4.5 mm wherein there was not observed retention of undispersed paper particles.

Example 3: Comparative Test Between the Conventional Paper Manufacturing Method for Producing Paper for Cement Packages and the Dispersible Paper Production Method of the Invention The example below shows a typical condition of kraft sack paper manufacturing with a grammage of 83 g/m$^2$ used in manufacturing bags with 50 kg capacity. Similarly to what was used in the dispersion test of a conventional cement bag.

For the effect of comparison between the conventional paper manufacturing method for producing paper for cement packages and the method for producing dispersible paper there follows a typical production condition of a kraft sack bag with a grammage of 83 g/m$^2$ in the paper machine 23 (MP 23) at the Correia unit, similarly to what was used in the manufacture of the conventional package used in the dispersion test.

The production of conventional paper used in the test consisted in the use of cellulosic pulp with cooking degree in terms of Kappa number of 56.0. The pulp was obtained from cooking *Pinus* ssp wood chips in Batch type digester by the kraft pulping process with the liquid wood ratio of 4:1; Applied Alkali Active of 18.7%, White Liquor Sulfidity of 25.6%, Maximum cooking temperature 169° C., and pH factor 1085, pH of 8.4. Conductivity of 1630 μS and refining degree of 730° CSF in the pure and washed pulp. It was refined in high consistency refining system (31%) to the refining degree of 620° CFS wherein there was applied a refining charge of 250 Kwh/t and to the refining degree of 587° CFS in low consistency refining system (4.0%) wherein there was applied a refining charge of 16.5 Kwh/t. In the paper machine with addition of 0.36% rosin-based glue, 0.5% cassava cationic starch, 4.4% Aluminum Sulfate, 0.45% Afranil MTC-Basf commercial defoamer, all added before the mixing pump and using a pH at the inlet box of 4.7. As drainage agent there was also added before the mixing pump, 0.05% of a solution of the drainage agent Polyvilamine Copolymer.

In these conditions the paper produced presents wet tensile strength in the MD direction of 0.50 kN/m and a Klemm capillary rise of 0.5 mm, evidencing the effect of the alteration of the manufacturing recipe in these properties. A low capillary rise makes the rapid penetration of water in the paper structures difficult, increasing the time necessary for the water to reach and break the hydrogen bond type bonds, which are the main bonds which maintain the fibers united. In the same manner, the elevation of the wet resistance increases the amount of energy necessary for the mechanical separation of these fibers. These two factors prevent the dispersion of the conventional paper in the preparation conditions of the concretes.

The low being the results found for the remaining physical tests presented in table 5 next, which correspond to typical values of a conventional paper manufactured in the described conditions.

TABLE 5

Results of Physical Tests of dispersible paper

| Test | Method | Result |
|---|---|---|
| Tensile strength - MD (kN/m) | Tappi T-494 | 4.7 |
| Tensile strength - CD (kN/m) | Tappi T-494 | 4.7 |
| Elongation - MD (%) | Tappi T-494 | 8.3 |
| Elongation - CD (%) | Tappi T-494 | 8.0 |
| TEA - MD (J/m$^2$) | Tappi T-494 | 230 |
| TEA - CD (J/m$^2$) | Tappi T-494 | 244 |
| Tear Strength - MD (mN) | Tappi T-414 | 1374 |
| Tear Resistance - CD (mN) | Tappi T-494 | 1394 |
| Air Resistance (s/dL) | Tappi T-460 | 11.4 |

A valved bag already packed with cement was fractioned in ½ and used in the dispersion test which was conducted using a concrete mixer with capacity for 140 liters. There were used the components and proportions described in table 6 below.

TABLE 6

Components and their proportions in concrete

| Raw material | Amount (kg) |
|---|---|
| Cement CP II F 40 | 25.0 |
| Sand | 72.0 |
| Stones and pebbles | 145.2 |
| Water | 19.0 |

In a first test the preparation of concrete was initiated with the addition of water, next the stones and pebbles and subsequently the package with the cement.

It was placed under agitation for 2 minutes with the axis angle adjusted to 45°.

Sand was added and agitated for 3 more minutes.

Upon inspection the mixer was observed with large pieces of paper stuck in the internal paddles.

Two samples of approximately 5 kg were removed and washed over a sieve with an opening of 4.5 mm wherein there was observed retention of paper particles with large dimensions, larger than 2×2 cm, undispersed.

A second test was carried out increasing the mixing time after the addition of sand for 3 to 7 minutes, there being still found undispersed pieces of paper.

Thus, it is concluded that the alterations in the wet tensile strength and in the capillary rise facilitate the dispersion of paper in the concrete preparation conditions. Differently from what is cited in Patent document No. US20160348319, Pat. In GB1127177 and Pat. No. US2018051417 which adopt or employ the addition of chemical agents to reduce the wet resistance of the papers, the process described in the present invention consists in elevating the manufacturing pH to 8.5 and in the suppression of chemical agents normally used in paper manufacturing and which collaborate for the increase in resistance and for the reduction in the capillary absorption of the paper making the paper more water absorbent and less wet resistant, which characteristics are necessary for the dispersion thereof in the concrete mixtures, effect reinforced by the use of a more soluble adhesive in the confection of the bags, which allows a quick rupture of the welded regions of the package when in contact with water.

Having described examples of embodiments, it must be understood that the scope of the present invention covers other possible variations, being limited only by the contents of the attached claims, there being included therein the possible equivalents.

The invention claimed is:

1. A dispersible paper in aqueous medium, comprising:

(i) an unbleached monolayer kraft sack paper comprised of 100% cellulose fibers with a grammage varying between 60 and 110 g/m$^2$;

(ii) 0.01 to 0.1 wt. % of at least one defoamer; and (iii) 0.05 to 0.5 wt. % of at least one drainage aid;

wherein the paper is free of a disintegration agent, a gluing agent, and a dry resistance agent, and wherein the paper is free of a non-ionic, anionic, cationic, or amphoteric surfactant, aluminum sulfate, aluminum polychloride, and starch, and wherein the paper has a wet tensile strength according to ISO 3781 of less than 0.35 kN/m and a Klemm capillary rise according to ISO 8787 above 18 mm, such that the paper is dispersible in concrete or aqueous suspensions of construction products within up to 5 minutes of mixing.

2. The dispersible paper according to claim 1, wherein the at least one defoamer is selected from: an alcohol-based defoamer, a fatty acid, a fatty ester, a polymer based on oxyethylene, oxypropylene and oxybutylene units, and a mixture thereof.

3. The dispersible paper according to claim 1, wherein the at least one drainage aid is selected from: a polyamine, polyacrylamide copolymer, polyvilamine copolymer, polyethyleneimine, polydiallyldimethylammonium chloride, and a mixture thereof.

* * * * *